US009444191B2

(12) United States Patent
Derbogen et al.

(10) Patent No.: US 9,444,191 B2
(45) Date of Patent: Sep. 13, 2016

(54) SHIELDED PLUG CONNECTOR AND METHOD FOR PRODUCING A SHIELDED PLUG CONNECTOR

(71) Applicants: Jan Derbogen, Rottenburg (DE); Nihat Kara, Walddorfhaeslach (DE); Uwe Widmann, Baltmannsweiler (DE)

(72) Inventors: Jan Derbogen, Rottenburg (DE); Nihat Kara, Walddorfhaeslach (DE); Uwe Widmann, Baltmannsweiler (DE)

(73) Assignee: HIRSCHMANN AUTOMATION AND CONTROL GMBH, Neckartenzlingen (DE)

( * ) Notice: Subject to any disclaimer, the term of this patent is extended or adjusted under 35 U.S.C. 154(b) by 0 days.

(21) Appl. No.: 14/240,820

(22) PCT Filed: Nov. 9, 2012

(86) PCT No.: PCT/EP2012/072320

§ 371 (c)(1),
(2) Date: May 9, 2014

(87) PCT Pub. No.: WO2013/068560

PCT Pub. Date: May 16, 2013

(65) Prior Publication Data

US 2014/0235101 A1 Aug. 21, 2014

(30) Foreign Application Priority Data

Nov. 10, 2011 (DE) ..... 10 2011 086 117

(51) Int. Cl.

| | |
|---|---|
| ***H01R 9/03*** | (2006.01) |
| ***H01R 13/6581*** | (2011.01) |
| ***H01R 13/658*** | (2011.01) |

(Continued)

(52) U.S. Cl.

CPC ..... *H01R 13/6581* (2013.01); *H01R 9/032* (2013.01); *H01R 13/658* (2013.01); *H01R 43/20* (2013.01); *H01R 13/50* (2013.01); *H01R 13/504* (2013.01); *H01R 13/64* (2013.01); *Y10T 29/49208* (2015.01)

(58) Field of Classification Search

CPC ..... H01R 13/658; H01R 13/506; H01R 2103/00

USPC ..... 439/607.41, 607.51, 694, 902

See application file for complete search history.

(56) References Cited

U.S. PATENT DOCUMENTS 3,721,939 A * 3/1973 Paugh ..... H01R 13/502 439/354
4,634,208 A * 1/1987 Hall ..... H01R 9/032 439/607.51

(Continued)

FOREIGN PATENT DOCUMENTS

DE 202006000336 U 4/2006
WO 2008117132 A 10/2008

*Primary Examiner* — Hae Moon Hyeon
(74) *Attorney, Agent, or Firm* — Andrew Wilford

(57) ABSTRACT

A shielded plug connector for use with a cable having a plurality of conductors surrounded by a shield braid has an electrically nonconductive contact support and an electrically conductive shield sleeve surrounding the contact support. Respective contact members at ends of the electrical conductors are held in the shield sleeve. An electrically conductive one-piece shield shell extends from the shield braid at an end of the cable to the contact support surrounded by the shield sleeve in electrical contact with the shield sleeve and is formed along the cable with a throughgoing slot so as to be radially compressible. A compression ring or the like compresses the shield shell inward at the slot against the cable and the shield braid thereof.

11 Claims, 7 Drawing Sheets

(51) Int. Cl.

| | |
|---|---|
| ***H01R 43/20*** | (2006.01) |
| *H01R 13/50* | (2006.01) |
| *H01R 13/504* | (2006.01) |
| *H01R 13/64* | (2006.01) |

(56) References Cited

U.S. PATENT DOCUMENTS 6,805,588 B2 * 10/2004 Yamamoto ..... H01R 9/035 439/607.41
7,390,221 B2 * 6/2008 Akino ..... H01R 9/0518 439/108
7,959,475 B2 * 6/2011 Wellmann ..... H01R 9/032 439/752.5
7,976,341 B2 7/2011 Osenberg
2006/0046570 A1 * 3/2006 Akino ..... H01R 9/032 439/607.41
2008/0293298 A1 * 11/2008 Burris ..... H01R 13/025 439/582

* cited by examiner

Fig. 4B
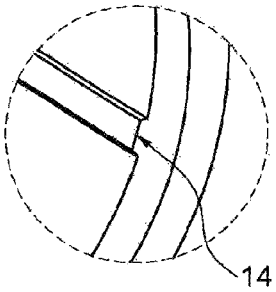
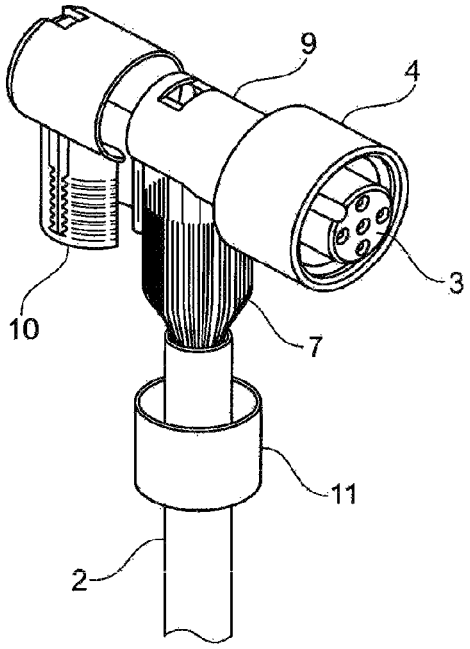
Fig. 3
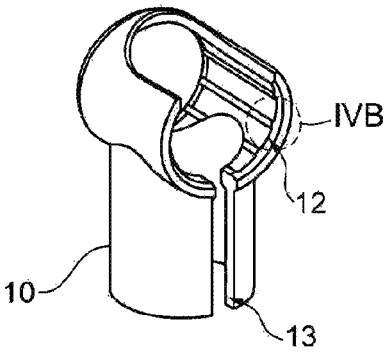
Fig. 4A
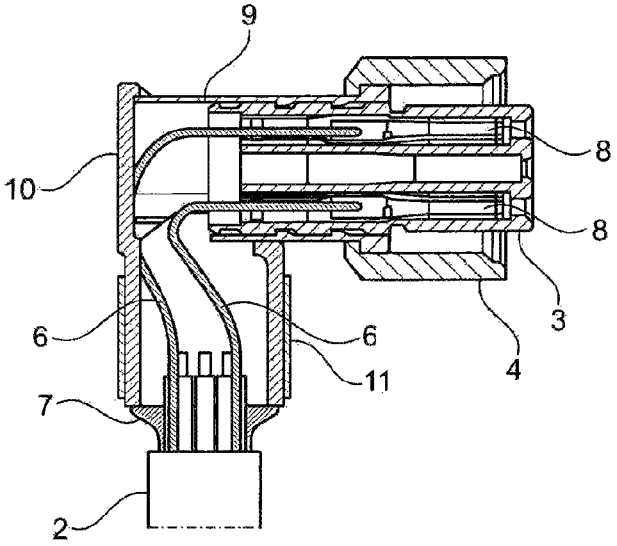
Fig. 5

SHIELDED PLUG CONNECTOR AND METHOD FOR PRODUCING A SHIELDED PLUG CONNECTOR

CROSS REFERENCE TO RELATED APPLICATIONS

This application is the US-national stage of PCT application EP2012/072320 filed 9 Nov. 2012 and claiming the priority of German patent application 102011086117.3 itself filed 10 Nov. 2011.

FIELD OF THE INVENTION

The invention relates to a shielded plug connector as well as to a method of manufacturing a shielded plug connector having an assembly comprising a contact support surrounded by a shield sleeve and in which contact members (8) are provided at the end of electrical conductors of a cable having a shield braid, a shield casing formed by the shield sleeve and a shield shell is extending from an end of the cable extending from the end of the cable to the contact support.

BACKGROUND OF THE INVENTION

From the similar document U.S. Pat. No. 7,976,341, a shielded plug connector is known, here an angled design, having an assembly comprising a contact support surrounded by a shield sleeve, with contact members in the contact support provided at the end of electrical conductors of a cable having a shield braid, and with a shield casing formed by a shield shell extending from the shield sleeve and from an end of the cable to the contact support. Such a shielded plug connector makes it possible for signals, particularly high-frequency signals, to be transmitted via the electrical conductors of the cable and the contact members provided at their ends. When the plug connector is plugged into with a complementary plug connector, it is necessary not only to plug together the contact members of the plug connector and of the respective mating plug connector, but rather continuous shielding of the transmitted signals from interference radiation must be provided. At the same time, continuous shielding along the cable as well as at the plug connection ensures that the emission of high-frequency signals from the electrical conductors to the outside is prevented. To this end, a plug connector is provided in the known prior art at the end of a cable that has, as known per se, a shield braid or the like. This plug connector has a contact support that, in turn, has contact chambers with contact members provided on them. The contact support consists of electrically nonconductive material (such as a plastic, for example), so that it must be surrounded by shielding. This shield casing, which extends from the end of the cable to the contact support and optionally to a knurled nut or the like, consists here of several parts. A shield sleeve made of an electrically conductive material is provided coaxially via the contact support in the axial direction. This shield sleeve has an electrically conductive connection to a connecting member, for example a retaining screw, a knurled nut, or the like. This connecting member ensures that, when the plug connector has been plugged together with a mating plug connector, it is mechanically fixed via this connecting member to a respective connecting member of the mating plug connector (in order to prevent disconnection) and, at the same time, is electrically connected. As a result of this electrical connection, shielding is also ensured beyond the plug connection.

Furthermore, in the category-forming prior art, the shield casing not only comprises the shield sleeve, but rather another shield shell formed as two shield shell halves. The shield shell has a cylindrical wall and a flange with which the shield shell is held to the plug insert by a retaining screw. Moreover, the shield shell has a groove into which the shield shell halves of the shield engage with corresponding creases. To ensure the proper alignment of the shield shell halves, stops are also provided. Each of the shield shell halves has an opening for the injection of hot-melt adhesive. Moreover, the shield shell halves have pins that engage in complementary holes in the other half of the housing. The dimensions are such that a press fit is achieved during assembly of the shield shell halves.

This design of the shield shell as two parts is extremely elaborate to manufacture, since the two shield casing halves to be joined together have a delicate geometry. What is more, the openings through which the hot-melt adhesive must be introduced into the shield shell are disadvantageous with respect to high frequency, since these openings do not provide shielding. Consequently, interference signals can penetrate through these openings into the interior of the plug connector or even emerge to the outside. The required high-frequency seal (shielding) is therefore not satisfactorily ensured.

OBJECT OF THE INVENTION

It is therefore the object of the invention to provide a shielded plug connector and a method of manufacturing such a shielded plug connector with which the drawbacks explained above are avoided. In particular, the intention is to ensure that a shielding effect is provided that is improved compared to the prior art, all while simplifying the manufacture of the plug connector and reducing the number of parts.

SUMMARY OF THE INVENTION

As concerns the construction of the shielded plug connector, according to the invention the object is attained by making the shield casing in a single piece. In particular, it is fixed in a press fit on the cable. In this way, the shield casing that is formed in the prior art by the shield shell and the two halves of the shield casing are replaced by the shield sleeve together with the one-piece shield casing. This offers the advantage that the number of parts is reduced. Moreover, the one-piece shield casing advantageously has no openings for introducing hot-melt adhesive or the like, so that only those openings are present that are required for putting together the assembly (shield sleeve, contact support, connecting member and the like). The shield casing has no other openings, so that it provides a complete high-frequency seal for the interior region in which the end of the cable and the contact support are provided. If another opening is provided for feeding in filler material (such as hot-melt adhesive), the opening is made to be so small that high-frequency shielding is ensured. In this way, it is advantageously ensured that no interference radiation is able to penetrate into the plug connector from outside, and high-frequency signals are also prevented from being emitted from the plug connector to the outside. Moreover, the one-piece shield casing is solidly press-fitted to the cable, thus substantially simplifying assembly. Finally, when the shield casing is fixed to the cable, the shield braid of the cable is simultaneously contacted and, at the same time, strain relief is provided.

In a development of the invention, the shield casing has a slot. This slot makes it possible to insert the assembly together with the cable into the shield casing and to press the region of the shield casing together around the slot in order to get the press fit, in which case an end of the cable or even a prepared end of the shield braid of the cable is then at the pressed-together slot.

In a development of the invention, a crimp sleeve coaxially surround the shield casing at the slot therein. This crimp sleeve presses that region of the shield casing in which the slot is present against the shield braid. Moreover, if the crimp sleeve is made of an electrically conductive material, it offers the advantage that the unaltered slot of the shield casing is sealed against high frequencies. This is also true in the event that it is still slightly open after the compression, in which case it seals off the remaining gap, thus further improving the high-frequency shielding. What is more, assembly can be further simplified with the mounting and compression of the crimp sleeve: When the assembly has been inserted into the shield casing and the slot has not yet been pressed together, the crimp sleeve can be pushed over the not yet pressed-together slot and both can be pressed together simultaneously.

In a development of the invention, the shield braid bears against an inner and/or outer surface of the shield casing. As a result, several possibilities are available for connecting the shield braid electrically and mechanically to the shield casing. Accordingly, it advantageously bears against an outer surface if the crimp sleeve is additionally used. As a result of the compression of the crimp sleeve, the shield braid is thus pressed against an outer surface of the shield casing and mechanically fixed in its position, while being electrically contacted in the process. Alternatively or in addition, the shield braid can also bear against an inner surface of the shield casing. In that case, the end of the cable is prepared, for example, such that the shield braid is exposed and laid over toward the remaining end of the cable sheath, so that one end of the shield casing, particularly the region with the slot, is provided and pressed together there. Here, too, the crimp sleeve can, but need not, be used. In these two cases cited above, very simple variants are available in assembly technology for connecting the shield braid to the shield casing. Although less practical, the shield braid can conceivably be prepared and the assembly process carried out such that the shield braid bears against both an inner surface and an outer surface of the shield casing. In this context, it should be noted that the term "shield braid" is understood as referring to all variants of a shielding of a cable, particularly a coaxial cable. That is, the shielding that encloses the at least one, and oftentimes several internal conductors of the cable, and is provided coaxially under the cable sheath need not necessarily be formed as a mesh but can take another form as well.

In a development of the invention, the shield casing has at least one projection in the region in which the shield casing encloses the shield sleeve. Especially advantageously, several projections are provided that are distributed over the periphery of the shield shell. As a result of these projections, which are preferably formed as ribs, defined points of contact between the shield sleeve (or, more specifically, its surface) and the single-piece shield shell (or, more specifically, its inner surface) upon pressing-in of the shield sleeve.

In a development of the invention, a hot-melt adhesive jacket is provided at least on the outer surface and/or on an inner surface. As a result, a mechanically stable connection is achieved between the end of the cable, the contact support and the shield casing (formed by the shield shell and the shield sleeve). The filling-out of the hollow space within the shield casing with a hot-melt adhesive generates a media-tight composite that prevents water and the like from entering between the metallic parts of the shield casing and into the interior of the shielded plug connector. The plug connector is particularly provided with longitudinal water-tightness as a result of being filled with hot-melt adhesive.

In a development of the invention, at least the shield shell is surrounded at least on its outer surface by an molded jacket. As a result of the molded jacket of the plug connector, a housing is obtained that extends from the end of the cable (also optionally reaching over a part of the cable) toward the connecting member for the mating plug connector (knurled nut, lock nut, or the like). This can easily be done automatically in a plastic injection molding process, in which the pre-assembled plug connector is placed into an injection mold and then the plastic housing is injected. In doing so, it must be ensured that the connecting member can still rotate freely about the shield sleeve.

With respect to the method of manufacturing a shielded plug connector, a provision is made according to the invention that a one-piece shield shell is provided between an end of the shield sleeve and an end of the cable and is fixed in a press fit on the shield braid that bears against an inner surface of the shield casing. As mentioned above, by virtue of the shield shell being formed in one piece, the number of parts can be reduced and is assembly simplified, since only one part needs to be handled during assembly. This one part offers the advantage that the prepared assembly that is provided at the end of the cable is inserted into the one-piece shield shell, and the shield shell must be pressed together in order to achieve the press fit. As a result of the compression, the shield shell is fixed to the end of the cable and simultaneously contacted with the shield braid of the cable.

In a development of the method of the invention, a slot is pressed together in the shield shell, so that this region of the shield shell is fitted over the end of the cable in a fixed position. Therefore, the region of the shield shell in which the slot is provided can be fixed on the outer sheath of the cable, with other measures required in order to electrically contact the shield braid to the shield casing, particularly its shield sleeve or the shield shell. Alternatively or in addition to this, the region of the shield shell in which the slot is located also lies in good electrical contact around the shield braid. Therefore, either two steps are required in order to mechanically fix the shield shell in position to the cable on the one hand and to electrically contact the shield casing to the shield braid on the other hand. Preferably, however, this is performed in one step. Likewise alternatively or in addition, after the compression of the slot, the shield braid is placed around an outer surface of the shield shell and subsequently surrounded coaxially by a crimp sleeve in a fixed position and in good electrical contact. The crimp sleeve makes it possible to seal off the slot against high frequencies (if it still has a small gap after being pressed together) while still fixing the shield braid to the shield shell by the crimp sleeve in a fixed position and good electrical contact. To this end, the shield braid is then located coaxially between an inner surface of the crimp sleeve and an outer surface of the shield shell at the slot, optionally overlapping.

BRIEF DESCRIPTION OF THE DRAWING

An illustrated embodiment of a shielded plug connector as well as its method of manufacture is described in the following and explained with reference to the figures. In which:

FIG. 3 is a view like FIG. 1 of the connector in another step of its assembly;

FIG. 4A is a perspective view of the connector's shield shell;

FIG. 4B is a large-scale view of the detail indicated at IVB in FIG. 4A;

FIGS. 5, 6, and 7 are sections like FIG. 2B showing the connector in a subsequent steps of its assembly;

SPECIFIC DESCRIPTION OF THE INVENTION

Figure 1:
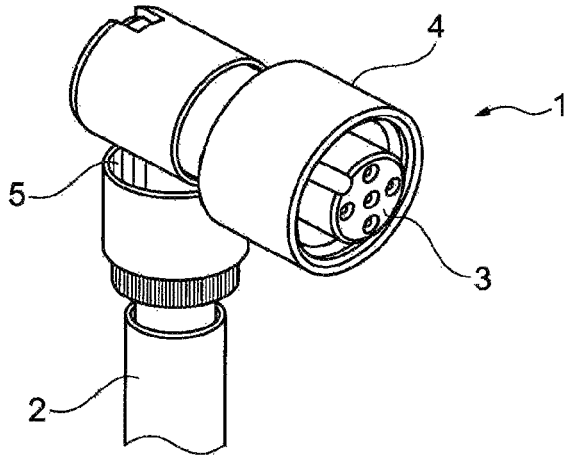
FIG. 1 is a perspective front view of the finished connector according to the invention.

FIG. 1 shows an embodiment of a plug connector 1, here an angular plug connector. Straight embodiments are also conceivable. The plug connector 1 is at the end of a cable 2 and has a contact support 3 as well as a connecting member for a mating plug connector (not shown here). The connecting member is a knurled nut 4, retaining screw, or the like. Preferably, the plug connector 1 is round, but other shapes are not excluded. To achieve continuous shielding, the plug connector 1 has a shield casing 5 described in further detail below. Here, the cable 2 is a data cable with one or more electrical conductors via which data signals are transmitted. To prevent interference radiation from getting into or emerging from the cable 2, it has shielding, it being of fundamental importance that this shielding be electrically contacted by the shield casing 5. The shield casing 5 and the connecting member, which must also be made of an electrically conductive material and is likewise electrically contacted by the shield casing 5, ensure that the shielding is continuous when the plug connector 1 is mated with a complementary other plug connector (not shown). As will readily be understood, the other plug connector also has such a shield casing and a data cable that in turn has a shield braid. Instead of the mating plug connector, the plug connector 1 can also be connected, for example, to a circuit board or to a mating plug connector protruding from the housing of a control device or the like.

Figure 2A:
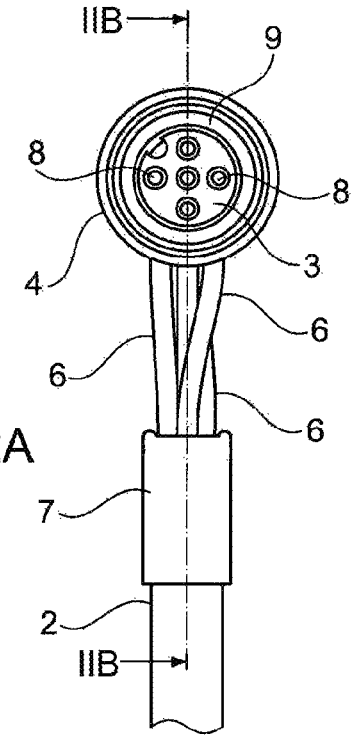
FIG. 2A is a front elevational view of the connector during a first assembly step.
Figure 2B:
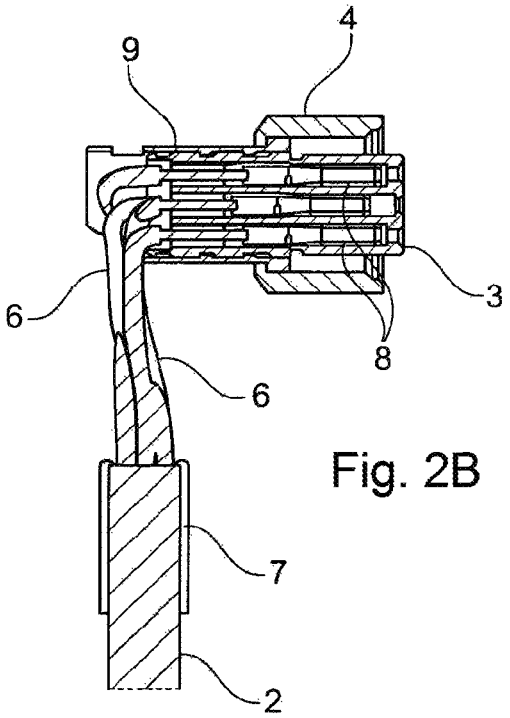
FIG. 2B is a section taken along line IIB-IIB of FIG. 2A.

FIGS. 2A and 2B show the elements of the assembly at the end of the cable 2. These are the electrical conductors 6 that extend in the cable 2. A shield braid of the cable 2 is indicated at 7. Moreover, one or more contact members 8 are provided in respective contact chambers in the contact support 3 that is made of electrically nonconductive material (plastic, for example). Moreover, there is a shield sleeve that encloses the contact support 3 coaxially at least in part, this shield sleeve 9 (as in the prior art) being a component of the shield casing 5. The assembly shown in FIGS. 2A and 2B is prepared as follows for the further manufacturing of the plug connector 1. This means that the contact members 8 are provided at the end of the electrical conductors 6, for example soldered, crimped or the like, and the contact members 8 are inserted into the respective contact chambers of the contact support 3. Furthermore, the knurled nut 4 is operatively connected to the shield sleeve 9, while ensuring that the knurled nut 4 can still be rotated on the shield sleeve 9. Furthermore, the end of the cable 2 is prepared such that a portion of the shield braid 7 is exposed and hence accessible for further contact. As regards the connection between the electrical conductors 6 and the contact members 8, the following should also be mentioned. An embodiment is conceivable in which the electrical conductors 6 of the cable 2 lead directly into the contact support 3 where they are connected to the respective contact member 8. Alternatively, it is conceivable that the electrical conductors 6 end just short of the end of the cable 2 and additional electrical conductors are provided there that, in turn, lead to the contact members 8. In that variant, it is also conceivable for the contact members 8 to be formed such that they enable contact toward the front end of the contact support 3, on the one hand, and lead, on the other hand, in a single piece in the other direction to the end of the electrical conductor 6 of the cable 2 and are contacted there.

FIG. 3 shows the next assembly step, in which the assembly prepared according to FIGS. 2A and 2B is inserted into a one-piece shield shell 10. Here, it can be seen that the shield braid 7 has been prepared such that it can be operatively connected to, above all brought into electrical contact with, the end of the shield shell 10 pointing downward as shown in FIG. 3. At the same time, the shield shell 10 is connected to one end of the shield sleeve 9, and the two parts, namely the shield sleeve 9 and the shield shell 10, form the complete shield casing 5 (see FIG. 1). The interfit of the shield sleeve 9 and the one-piece shield shell 10, inside of which the prepared assembly is seated, provides substantially complete shielding. This shielding is achieved above all because one end of the one-piece shield shell 10 is connected to the shield braid 7, and the other end of the one-piece shield shell 10 is connected to a rear end of the shield sleeve 9. The front end of the shield sleeve 9 extends toward the front end of the contact support 3 but does not reach it. In order to shield the region of the contact support 3 as well, which is not surrounded by the shield sleeve 9, from high frequencies, the connecting member, in this case particularly the knurled nut 4, is provided that encloses the contact support 3 coaxially while leaving a gap. The gap is suited and designed to connect a respective connecting member of the mating plug connector that is to be operatively connected to the connecting member (particularly the knurled nut 4). Complete shielding of such an assembled plug connection, consisting of the plug connector 1 and mating plug connector, is achieved in this way. FIG. 3 also shows an optional crimp sleeve 11 coaxially enclosing the cable 2. In FIG. 3, the crimp sleeve 11 is shown in its pre-assembly position. The assembly and final position thereof will be discussed further below.

Figure 8A:
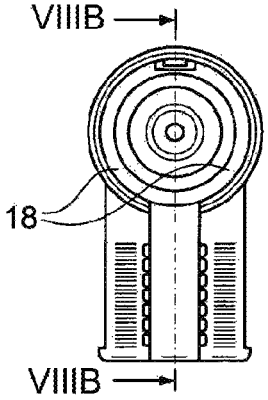
FIG. 8A is a front elevational view of the shield shell of another the connector according to the invention.
Figure 8B:
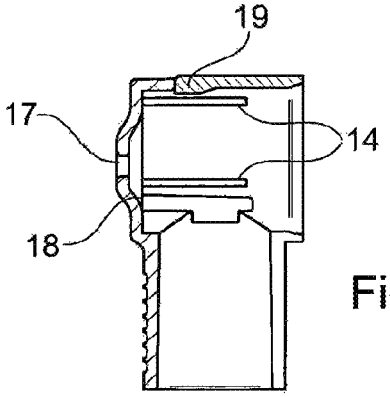
FIG. 8B is a section taken along line VIIIB-VIIIB of FIG. 8A.
Figure 8C:
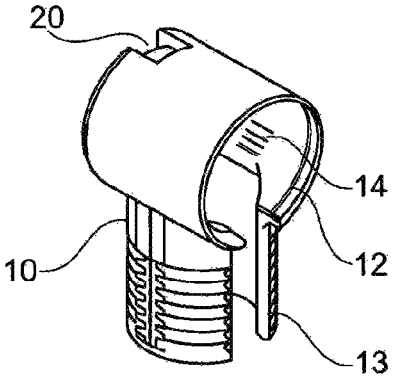
FIGS. 8C and 8D are perspective views from above of the shield shell of FIGS. 8A and 8B, respectively from in front and back.
Figure 8D:
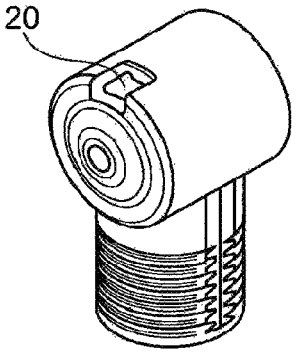
Figure 9A:
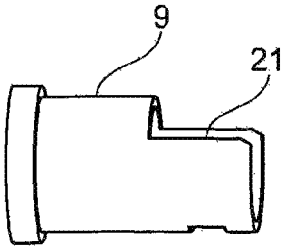
FIG. 9A is a side view of the connector's shield sleeve of the connector of FIG. 6.
Figure 9B:
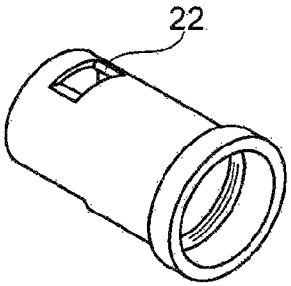
FIG. 9B is a perspective front view of the shield sleeve of FIG. 9A.

FIGS. 4A and 4*b* show s the one-piece shield shell 10 once again. It can be seen here that the shield shell 10 has an opening that is suited and designed to receive the assembly prepared according to FIGS. 2A and 2B, particularly one end of the shield sleeve 9. A slot 13 is also provided in the part of the shield shell 10 extending away from the opening 12. The width of the slot 13 is selected here such that the assembly prepared according to FIGS. 2A and 2B, particularly the end of the cable 2 (or, alternatively, the electrical conductors 6 that extend from the end of the cable 2), can be passed through the slot 13. FIGS. 4A and 4B also show that the interior of the shield shell 10 that is to be operatively connected to the end of the shield sleeve 9 has at least one projection 14 (see FIGS. 8B and 8C), preferably several projections 14 distributed over the periphery. As a result of these projections 14, particularly formed as ribs, defined points of contact between the surface of the shield sleeve 9 and the interior of the shield shell 10 are formed when the shield sleeve 9 is pressed into the end of the shield shell 10 on the side where the opening 12 is located. This ensures a high level of contact reliability for implementation of continuous shielding.

FIG. 5 is a section through an embodiment of the plug connector 1 in which the assembly prepared according to FIGS. 2A and 2B has been inserted into the shield shell 10, the shield sleeve 9 being provided, for example pressed, in the shield shell 10 in a fixed position. In the lower part when viewing FIG. 5, the shield shell 10 is fixed in a press fit on the cable 2, more specifically on the shield braid 7 that is a component of the cable 2. In this variant, the shield braid 7 is clamped between the outer surface of the shield shell 10 and the inner of the crimp sleeve 11. This means that the crimp sleeve 11 is used here, for one, to additionally seal off the slot 13 after it is compressed (insofar as a gap remains) and, for another, to electrically fix the shield braid 7 in position on the surface of the shield shell 10 and simultaneously establish an electrical contact. One alternative variant would be to insert the end of the cable 2 into the shield shell 10 toward the lower end thereof, so that an end of the cable sheath of the cable 2 also protrudes into the shield shell 10 as well. This variant offers the advantage that strain relief is simultaneously provided.

Figure 6:
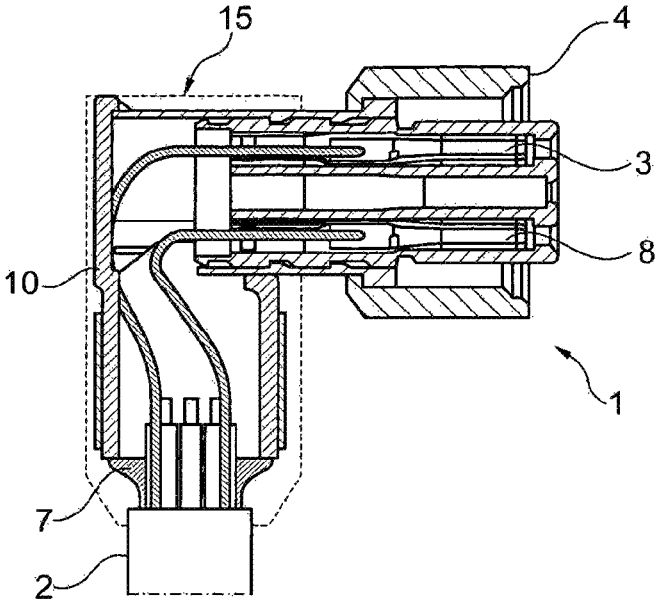
Figure 7:
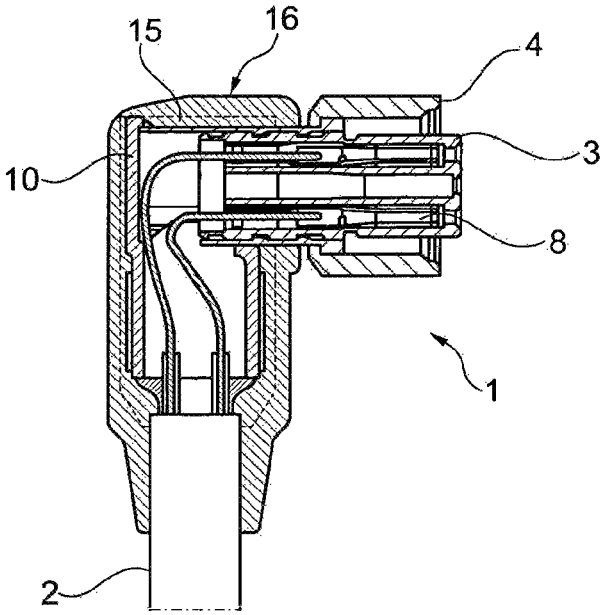

In a variant shown in FIG. 5, in which the cable 2 is not fixed directly, but rather its shield braid 7 is fixed in a press fit on the shield shell 10, it is also necessary to take additional measures in order to achieve mechanical stability in the plug connector 1 later. This mechanical stability can be achieved in different ways. FIG. 6 shows, for example, that the interior of the shield shell 10, overlapping a part of the end of the cable 2, is filled with a body of hot-melt adhesive 15. Such a hot-melt adhesive 15 offers the advantage, for one, that it fills up the remaining hollow spaces in the shield shell 10, thus achieving a media-tight bond that prevents water, contaminant particles, and the like from getting between the metallic parts in the interior of the plug connector 1. For another, as a result of the hot-melt adhesive 15, which is also present on the shield braid 7 and the end of the cable 2 (more specifically, its cable sheath), not only is longitudinal water-tightness achieved, but also a mechanical, preferably a first stability. After all, in the form as shown in FIG. 5, the shield braid 7 will generally not yet have the mechanical stability that is required for operation of the plug connector 1. This stability is only achieved by use of the hot-melt adhesive 5, as shown in FIG. 6. In the event that the mechanical stability achieved with the hot-melt adhesive 15 according to FIG. 6 is not yet sufficient or the hot-melt adhesive 15 does not extend over the end of the cable 2, a molded jacket 16 can alternatively or additionally be provided according to FIG. 7. Either this molded jacket 16 is formed such that it also reaches into the interior of the shield shell 10 and fills it up, thus simultaneously forming an outer casing of the plug connector 1. In such a case, the hot-melt adhesive 15 may be dispensable. However, if the hot-melt adhesive 15 has been introduced in order to provide longitudinal water-tightness, it can also very advantageously be surrounded by the molded jacket 16, because longitudinal water-tightness is achieved with the hot-melt adhesive 15 (or a comparable material that achieves a media-tight bond between the materials involved) and mechanical stability is only achieved by use of the molded jacket 16 or increased in conjunction with the hot-melt adhesive body 15.

FIGS. 8A to 13 show another embodiment of the plug connector 1 according to the invention that is essential to the is invention and whose essential elements, function and manufacture are based on the plug connector 1 shown in FIGS. 1 to 7.

Figure 10:
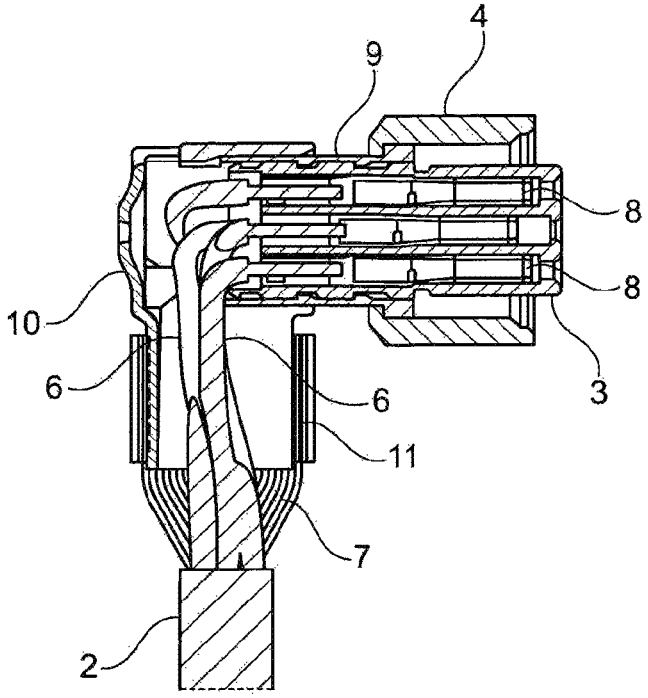
FIGS. 10 and 11A are sections like FIG. 6 showing the connector of FIG. 6 during assembly.
Figure 11A:
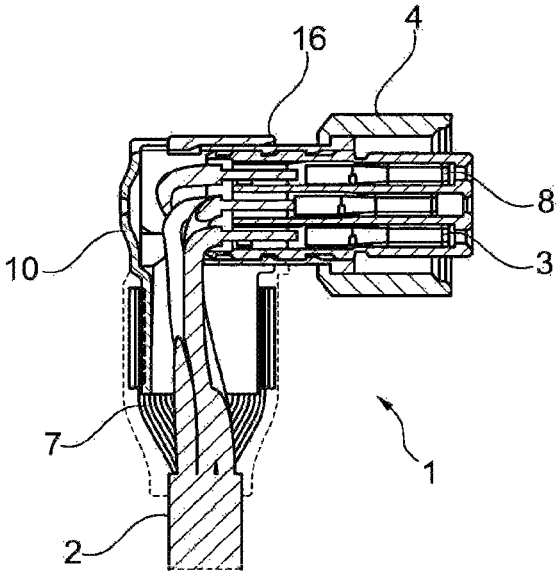
Figure 11B:
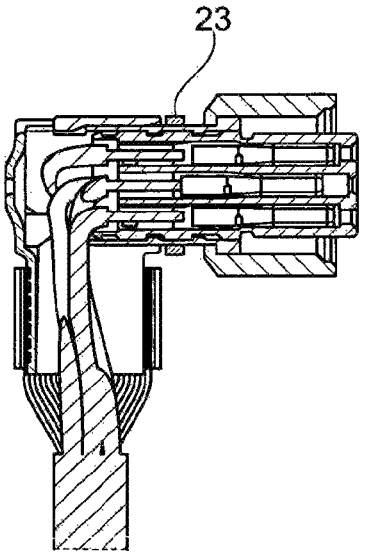
FIG. 11B is a view like FIG. 11A of a variant on the second embodiment.
Figure 12:
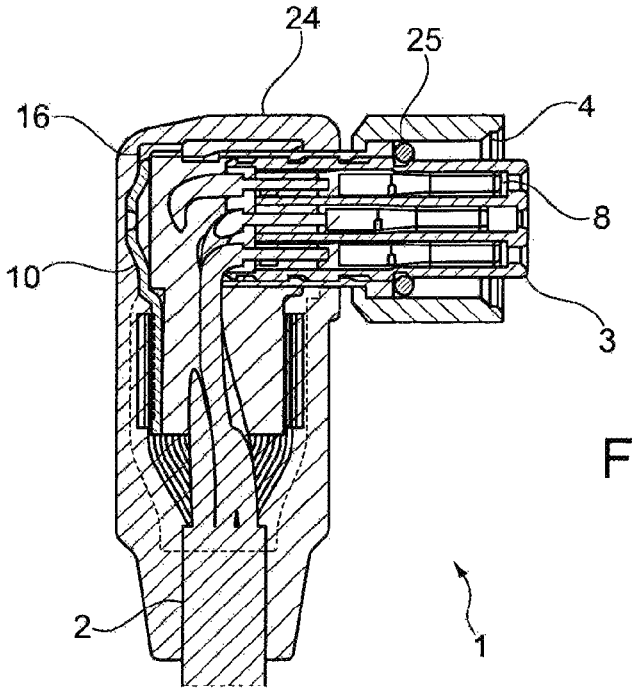
FIG. 12 is a section like FIG. 11A of the completed connector.
Figure 13B:
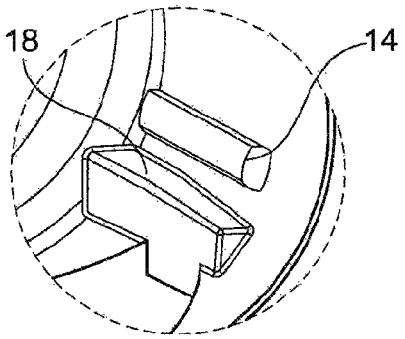
FIG. 13B is a large-scale view of the detail indicated at XIIIB in FIG. 13A.
Figure 13A:
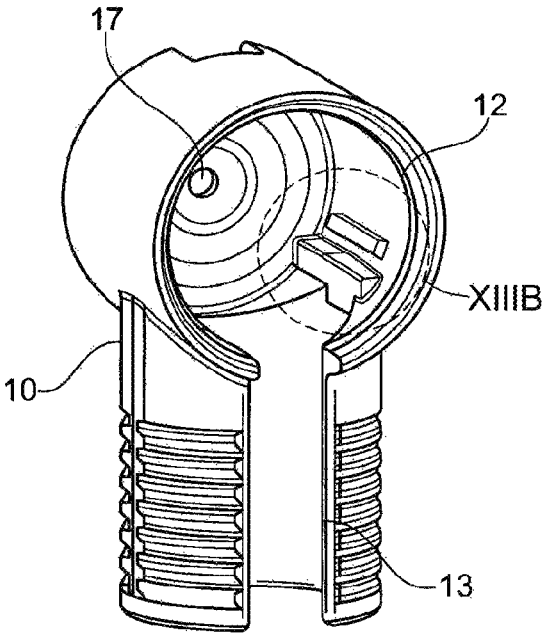
FIG. 13A is a large-scale perspective front view of the shield shell of the connector of FIG. 6.

FIGS. 8A to 8D show that the shield shell has an opening 17 in its upper cylindrical part at its rear end directed oppositely away from its front plug-face end. This opening 17 is provided in the shield shell 10 in a raised area that is slightly outwardly convex. Filler material, such as hot-melt adhesive or the like, can be injected through this opening 17 into the shield shell 10 (and, optionally, into the interior of the shield sleeve 9 as well). The diameter of the opening 17 is selected such that, for one, it is large enough to feed the desired quantity of filler material within a reasonable amount of time into the interior and, for another, high-frequency shielding is simultaneously ensured. The diameter of the opening 17 depends on the overall diameter of the cylindrical part of the shield shell 10 and is substantially smaller than it. Moreover, the shield shell 10 has two opposite offsets 18 that are present below the longitudinal axis of the cylindrical part of the shield shell 10. Furthermore, a detent 19 is also present in the shield shell 10 that is provided at an opening 20. The effect of the detent 19 is that the shield shell 10 can be latched to the shield sleeve 9 (see FIGS. 9A and 9B). To this end, the shield sleeve 9 has a recess 21 whose edges bear on the offsets 18 of the shield shell 10 when the shield sleeve 9 is inserted coaxially fully into the shield shell 10. In the process, the detent 19 and an opening 22 in the shield sleeve 9 also connect operatively, thus latching the shield sleeve 9 on the shield shell 10. This assembly state is shown in FIGS. 10 and 11A. While FIG. 10 shows that the interior of the shield sleeve 9 and of the shield shell 10 have not yet been filled with filler material (but can be filled), FIG. 11A shows that the interior and/or the exterior of shield sleeve 9 and shield shell 10 are filled and/or covered by the molded jacket 16. FIG. 11B shows a ring 23 that can, but need not, be provided. This ring 23 can also be formed by a hot-melt adhesive, a molded jacket or the like and encloses the elements disposed in it, such as the contact support 3, the contact members 8 and the like, in order to achieve longitudinal water-tightness. FIG. 12 only is a section through the finished plug connector 1, the molded jacket 16 being surrounded by an additional molded jacket 24 forming a casing. The hot-melt adhesive 15, the molded jacket 16 and the molded jacket 24 can be produced in successive method steps and consist of the same or of different materials. It should be mentioned here that not all three need to be used, but rather it may also be sufficient only to provide the molded jacket 16 forming the housing or the molded jacket 24 (for example then without the hot-melt adhesive 15).

FIGS. 13A and 13B again show, in detail, the embodiment of the shield shell 10 according to FIGS. 4A and 4B or according to FIGS. 8A to 8D. In this case, the shield shell 10 has either no opening or the opening 17. In both variants, an offset 18 is provided for positional fixation of the shield sleeve 9 in the shield shell 10, the two offsets 18 being located so as to confront and fit with each other in the shield shell 10. The plane on which the two offsets 18 are located is outside a plane that runs through the longitudinal axis of the cylindrical upper part of the shield shell 10 or of the shield sleeve 9. This ensures that the shield sleeve 9 comes to bear with longitudinal edges of the recess 21 on the two offsets 18 in order to be rotationally secured in the shield shell. Moreover, other designs are conceivable with which the shield sleeve is rotationally secured in the shield shell 10. Finally, FIGS. 13A and 13B also show the detail that the shield shell 10 has a raised surface in its downwardly pointing end, i.e., at the slot 13. This surface structure, preferably raised areas and recesses (alternately) pointing axially downward, ensures that a larger surface, and hence greater contact reliability, is provided for the shield braid.

Figure 14A:
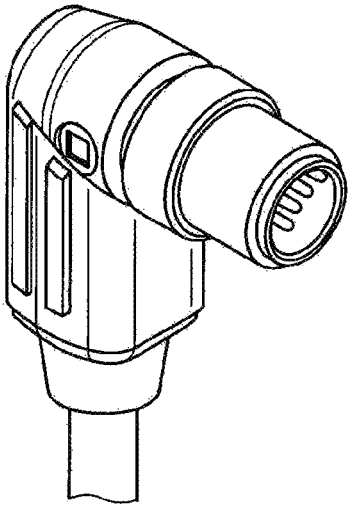
FIG. 14A is a perspective view of another connector according to the invention.
Figure 14B:
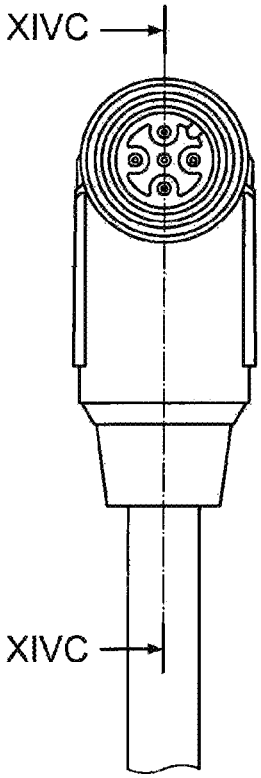
FIG. 14B is a front elevational view of the connector of FIG. 14A.
Figure 14C:
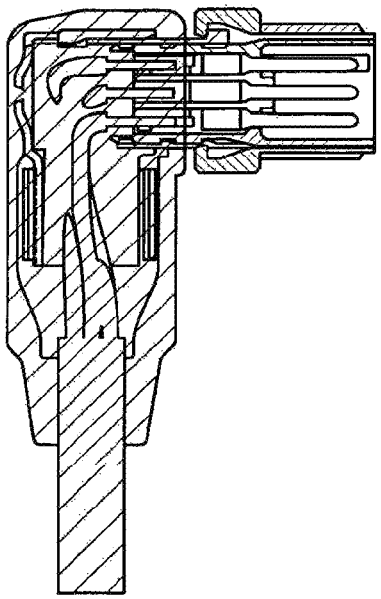
FIG. 14C is a section taken along line XIVC of FIG. 14B.

As regards the connection of the shield braid 7 to the cylindrical part of the shield shell, which points downward when looking at FIGS. 14A, 14B, and 14C, the following should also be noted. For one, the shield braid 7 can be provided within the cylindrical part of the shield shell 9. In that case, it is conceivable for the electrical conductors to be surrounded by a common sheath that, in turn is surrounded by the shield braid 7. In that case, the shield braid 7 can be supported either on the electrical conductors 6 (after the sheath has been removed) and/or on the sheath of the cable 2 if the cylindrical part of the shield shell 10 is provided above it and then fixed in the press fit. This assumes that the shield shell 10 is designed such and made of such a material that it can be pressed together, thus making the slot 13 smaller. In addition or alternatively, it is conceivable to wrap the entire shield braid 7 around the outer surface of the downwardly pointing cylindrical end of the shield shell 10, or to arrange it there partly on an inner surface and partly on an outer surface. The arrangement of the shield braid 7, more precisely the end thereof, on the outer surface of the lower end of the shield shell 10 is especially preferred. In that case, the shield shell 10 is designed such and made of such a material that, when the shield braid is fixed in a press fit on the shield shell 10, it does not deform when the shield braid is pressed or when the crimp sleeve 11 is pushed on and crimped together (or it deforms only slightly), so that the shield shell 10 provides a stable counterforce for the creation of the press fit. Alternatively or in addition to the press fit, it is conceivable to also fix and electrically contact the shield braid 7 using other methods and/or means on an inner surface and/or on an outer surface of the shield shell 10. Worthy of consideration here are, for example, welding, caulking, gluing (using an electrically conductive adhesive) or the like.

The invention claimed is:

1. A shielded plug connector for use with a cable having a plurality of electrical conductors surrounded by a shield braid, the connector comprising:

an electrically nonconductive contact support;

an electrically conductive shield sleeve surrounding the contact support;

respective contact members at ends of the electrical conductors in the shield sleeve and held by the non-conductive contact support;

an electrically conductive one-piece shield shell extending from the shield braid at an end of the cable to the contact support surrounded by the shield sleeve, in electrical contact with the shield sleeve, and formed along the cable with a throughgoing slot so as to be radially compressible; and means for compressing the shield shell inward at the slot against the cable and the shield braid thereof.

2. The shielded plug connector defined in claim 1, wherein the means is a crimp sleeve provided at and coaxially surrounding the shield shell at the slot.

3. The shielded plug connector defined in claim 1, wherein the shield braid bears against an inner surface of the shield shell.

4. The shielded plug connector defined in claim 1, wherein the shield shell has at least one projection in a region in which the shield shell encloses the shield sleeve.

5. The shielded plug connector defined in claim 4, wherein several projections are provided that are distributed over the periphery of the shield shell.

6. The shielded plug connector defined in claim 1, further comprising:

a hot-melt adhesive on an outer surface or on an inner surface of the shield shell.

7. The shielded plug connector defined in claim 1, wherein at least the shield shell is surrounded at least on its outer surface by a molded jacket.

8. The connector defined in claim 1, wherein the shield sleeve is cylindrically tubular and the shield shell has a cylindrically tubular outer end fitted coaxially with the shield sleeve and a cylindrically tubular inner end fitted around the cable end and formed with the slot.

9. The connector defined in claim 8, wherein the shield shell is L-shaped with its inner and outer ends extending at a right angle to each other.

10. A method of manufacturing a shielded plug connector for a cable having a plurality of electrical conductors surrounded by a shield braid, the method comprising the steps of:

surrounding with a shield sleeve a contact support in which contact members are provided at the ends of electrical conductors of the cable;

providing on the shield sleeve a shield shell extending from the shield braid at an end of the cable to the contact support and having a slot; and radially inwardly deforming the shield shell at the slot inward against the shield braid of the cable.

11. The method defined in claim 10, wherein a region of the shield shell at the slot is pressed together so that the shield shell is fitted and fixed at the region over the end of the cable or laid over the shield braid in electrical contact therewith or that, upon compression of the slot, the shield braid is pressed against an outer surface of the shield shell and then surrounded and fixed by a crimp sleeve in a coaxial electrical contact.

* * * * *